US005948122A

United States Patent [19]

Xu et al.

[11] Patent Number: 5,948,122

[45] Date of Patent: Sep. 7, 1999

[54] ENZYMATIC METHODS FOR DYEING WITH REDUCED VAT AND SULFUR DYES

[75] Inventors: Feng Xu, Woodland, Calif.; Sonja Irene Salmon, Raleigh, N.C.

[73] Assignees: Novo Nordisk Biotech, Inc., Davis, Calif.; Novo Nordisk BioChem North America Inc., Franklinton, N.C.; Novo Nordisk A/S, Denmark

[21] Appl. No.: 09/199,222

[22] Filed: Nov. 24, 1998

[51] Int. Cl.[6] ..... D06P 1/00; D06P 1/30; D06P 1/22; D06P 1/24

[52] U.S. Cl. ..... 8/401; 8/436; 8/111; 8/404; 8/602; 8/613; 8/650; 8/652; 8/653; 8/917; 8/921; 8/922; 8/924; 8/927; 435/263

[58] Field of Search ..... 8/401, 650, 651, 8/652, 653, 649; 435/263

[56] References Cited

U.S. PATENT DOCUMENTS

| | | | |
|---|---|---|---|
| 3,176,325 | 4/1965 | Aspland | 8/634 |
| 3,957,424 | 5/1976 | Zeffren et al. | 8/410 |
| 4,011,042 | 3/1977 | Stitzel | 8/634 |
| 4,036,586 | 7/1977 | Rowe | 8/624 |
| 4,131,423 | 12/1978 | Kato | 8/634 |
| 4,756,037 | 7/1988 | McFadyen et al. | 8/150 |
| 5,378,246 | 1/1995 | Gurley | 8/625 |
| 5,435,809 | 7/1995 | Holst et al. | 8/401 |

*Primary Examiner*—Yogendra Gupta
*Assistant Examiner*—Christine Ingersoll
*Attorney, Agent, or Firm*—Steve T. Zelson; Robert L. Starnes

[57] ABSTRACT

The present invention relates to methods for dyeing a material, comprising (a) treating the material with a dyeing system which comprises one or more reduced vat dyes and/or one or more reduced sulfur dyes; and (b) oxidizing the one or more reduced vat dyes or one or more reduced sulfur dyes adsorbed onto the treated material with an oxidation system comprising (i) an oxygen source and one or more enzymes exhibiting oxidase activity or (ii) a hydrogen peroxide source and one or more enzymes exhibiting peroxidase activity, to convert the one or more reduced dyes to their original oxidized insoluble colored forms; wherein the material is a fabric, yarn, fiber, garment or film made of cotton, diacetate, flax, fur, hide, leather, linen, lyocel, polyacrylic, polyamide, polyester, ramie, rayon, silk, tencel, triacetate, viscose or wool.

18 Claims, 5 Drawing Sheets

Vat Orange 7

Vat Blue 43

Indigo

ENZYMATIC METHODS FOR DYEING WITH REDUCED VAT AND SULFUR DYES

BACKGROUND OF THE INVENTION

1. Field of the Invention

The present invention relates to methods for dyeing a material, comprising treating the material with a dyeing system which comprises one or more reduced vat dyes and/or one or more reduced sulfur dyes, and oxidizing the one or more reduced vat dyes and/or one or more reduced sulfur dyes adsorbed onto the treated material with an oxidation system comprising (a) an oxygen source and one or more enzymes exhibiting oxidase activity or (b) a hydrogen peroxide source and one or more enzymes exhibiting peroxidase activity; wherein the material is a fabric, yarn, fiber, garment or film made of cotton, diacetate, flax, fur, hide, leather, linen, lyocel, polyacrylic, polyamide, polyester, ramie, rayon, silk, tencel, triacetate, viscose or wool. The present invention also relates to materials dyed by such methods.

2. Description of the Related Art

Dyeing of textiles is often the most important and expensive single step in the manufacturing of textile fabrics and garments. In the textile industry, two major types of processes are currently used for dyeing, i.e., batch and continuous. In the batch process, among others, jets, drums, and vat dyers are used. In continuous processes, among others, padding systems are used. See, e.g., I. D. Rattee, In C. M. Carr (editor), *The Chemistry of the Textiles Industry,* Blackie Academic and Professional, Glasgow, 1995, p. 276.

There are two types of dyes involving a reduction/oxidation mechanism, i.e., vat and sulfur dyes. The purpose of the reduction step in these dyeings is to change the dyestuff from an insoluble form to a soluble form. The oxidation step then converts the soluble dye back to the insoluble dye thereby fixing the dye to the dyed material.

Oxidoreductases, e.g., oxidases and peroxidases, are well known in the art.

One class of oxidoreductases is laccases (benzenediol:oxygen oxidoreductases) which are multicopper containing enzymes that catalyze the oxidation of phenols and related compounds. Laccase-mediated oxidation results in the production of aromatic radical intermediates from suitable substrates; the ultimate coupling of the intermediates so produced provides a combination of dimeric, oligomeric, and polymeric reaction products. Such reactions are important in nature in biosynthetic pathways which lead to the formation of melanin, alkaloids, toxins, lignins, and humic acids.

Another class of oxidoreductases are peroxidases which oxidize compounds in the presence of hydrogen peroxide.

Laccases have been found to be useful for hair dyeing. See, e.g., PCT applications Serial No. PCT/US95/06815 and PCT/US95/06816. European Patent No. 0504005 discloses that laccases can be used for dyeing wool at a pH in the range of between 6.5 and 8.0.

U.S. Pat. No. 5,538,517 disclosed methods for dyeing keratin fibers with indole or indoline derivatives which after oxidation with hydrogen peroxide in the presence of a peroxidase produces strong colorations.

Saunders et al., *Peroxidase,* London, 1964, p. 10 ff. disclose that peroxidases act on various amino and phenolic compounds resulting in the production of a color.

Japanese Patent Application publication no. 6-316874 discloses a method for dyeing cotton comprising treating the cotton with an oxygen-containing medium, wherein an oxidoreductase selected from the group consisting of ascorbate oxidase, bilirubin oxidase, catalase, laccase, peroxidase, and polyphenol oxidase is used to generate the oxygen.

Japanese Patent Application publication no. 2-104773 discloses a method for indigoid dyeing of a material using an enzyme selected from the group consisting of napthalene dioxygenase, toluene oxygenase, benzene dioxygenase, indole hydrolase, and xylene oxidase.

WO 91/05839 discloses that oxidases and peroxidases are useful for inhibiting the transfer of textile dyes.

Japanese Patent Application publication no. 08-127976 discloses a method for dyeing a keratin-coated fiber by immobilizing a peroxidase to the fiber, immersing the peroxidase-immobilized fiber in an aqueous solution containing a reduced dye, and enzymatically oxidizing the reduced dye in the presence of hydrogen peroxide with the immobilized peroxidase.

It is an object of the present invention to provide new enzymatic methods for dyeing materials with reduced vat and/or sulfur dyes.

SUMMARY OF THE INVENTION

The present invention relates to methods for dyeing a material, comprising (a) treating the material with a dyeing system which comprises one or more reduced vat dyes and/or one or more reduced sulfur dyes; and (b) oxidizing the one or more reduced vat dyes and/or one or more reduced sulfur dyes adsorbed onto the treated material with an oxidation system comprising (i) an oxygen source and one or more enzymes exhibiting oxidase activity or (ii) a hydrogen peroxide source and one or more enzymes exhibiting peroxidase activity, to convert the one or more reduced dyes to their original oxidized insoluble colored forms; wherein the material is a fabric, yarn, fiber, garment or film made of cotton, diacetate, flax, fur, hide, leather, linen, lyocel, polyacrylic, polyamide, polyester, ramie, rayon, silk, tencel, triacetate, or wool.

The present invention also relates to dyed materials obtained by the methods of the present invention.

DETAILED DESCRIPTION OF THE INVENTION

Figure 1:
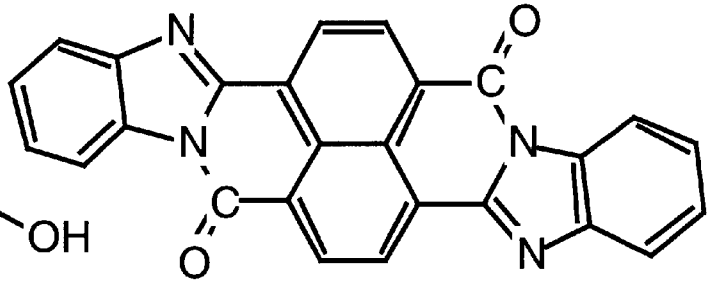
FIG. 1 shows the structures of indigo, Vat Blue 43, and Vat Orange 7.
Figure 1:
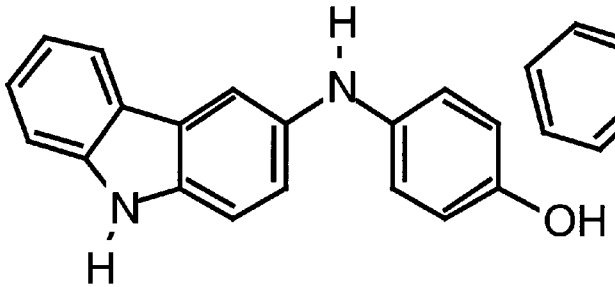
Figure 1:
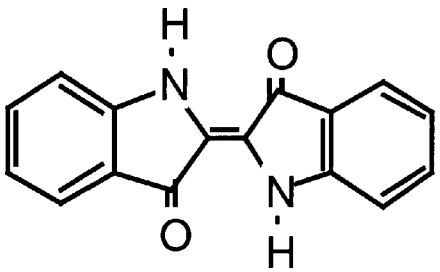

Conventional dyeing of a material such as a fabric with a vat or sulfur dye involves sequentially a chemical reduction of the dye to increase its water solubility, adsorption of the reduced dye by the material, and chemical oxidation of the adsorbed reduced dye to its original oxidized insoluble colored form to enhance the color fastness to the material. The chemical oxidation of the reduced dye can be accomplished either by simple exposure to air or more often by complex processing involving chemical oxidants (such as hydrogen peroxide, m-nitrobenzenesulfonate, perborate, hypochlorite, iodate, bromate, or dichromate), harsh conditions (high pH or temperature), and/or expensive/unsafe catalysts (such as metavanadate) (Hughey, 1980; *Textile Chemist and Colorist* 12: 38–39; U.S. Pat. No. 4,012,192, U.S. Pat. No. 4,036,586; U.S. Pat. No. 4,371,373; John Shore (editor), *Cellulosics Dyeing,* Society of Dyers and Colourists, West Yorkshire, England, 1995; Horne, 1995, *Textile Chemist and Colorist* 27: 27–32).

Replacing the chemical reoxidation step with an enzymatic approach employing one or more oxidoreductases provide several significant advantages. For example, the enzymatic reoxidation can be used to replace harsh and hazardous chemicals currently used to accomplish the reoxidation. Moreover, the mild process conditions (e.g., lower temperature and less time) will result in less damage to the fabric and lower energy consumption. Furthermore, the use of an oxidoreductase will provide better control of the oxidation process during dyeing avoiding uneven dyeing, low color yield, and unsuitable color fastness.

Thus, the present invention relates to methods for dyeing a material, comprising (a) treating the material with a dyeing system which comprises one or more reduced vat dyes and/or one or more reduced sulfur dyes; and (b) oxidizing the one or more reduced vat dyes and/or one or more reduced sulfur dyes adsorbed onto the treated material with an oxidation system comprising (i) an oxygen source and one or more enzymes exhibiting oxidase activity or (ii) a hydrogen peroxide source and one or more enzymes exhibiting peroxidase activity, to convert the one or more reduced dyes to their original oxidized insoluble colored forms.

Vat dyes contain two or more keto groups separated by a conjugated system of double bonds and may be any color. They are water-insoluble and have no affinity for a material if they remain in the insoluble state and, thus, can be applied to material, e.g., fabric, only in the reduced state. The reduced state is known as the leuco enolate form of the vat dye.

Vat dyes may be divided into the indigoids, anthraquinoids, and higher condensed aromatic ring systems with a closed system of conjugated double bonds. The chemical constitution of a vat dye influences the properties of the leuco enolate form in the dyeing process, e.g., thermal stability, substantivity, rate of absorption, diffusion into the fiber, and levelling, color, and fastness properties. The vat dyes may be homogeneous dyes or mixtures, each usually containing two, four, or six reducible keto groups.

The most important vat dyes are derivatives of anthraquinone carbazole, anthraquinone oxazole, benzanthrone acridone, dibenzanthrone, flavanthrone, indigo, imidazole, indanthrone, isodibenzanthrone, perylene tetracarboxylic diimide, pyranthrone, triazinylaminoanthraquinone, and violanthrone. In a preferred embodiment, the vat dye is an anthraquinone carbazole, anthraquinone oxazole, benzanthrone acridone, dibenzanthrone, flavanthrone, indigo, imidazole, indanthrone, isodibenzanthrone, perylene tetracarboxylic diimide, pyranthrone, or triazinylaminoanthraquinone dye, each of which are optionally substituted with one or more mono-, di- or polycyclic aromatic or polycyclic heteroaromatic compounds. Examples of such mono-, di- or polycyclic aromatic or heteroaromatic compounds include, but are not limited to, acridine, anthracene, azulene, benzene, benzofurane, benzothiazole, benzothiazoline, carboline, carbazole, cinnoline, chromane, chromene, chrysene, fulvene, furan, imidazole, indazole, indene, indole, indoline, indolizine, isothiazole, isoquinoline, isoxazole, naphthalene, naphthylene, naphthylpyridine, oxazole, perylene, phenanthrene, phenazine, phtalizine, pteridine, purine, pyran, pyrazole, pyrene, pyridazine, pyridazone, pyridine, pyrimidine, pyrrole, quinazoline, quinoline, quinoxaline, sulfonyl, thiophene, and triazine, each of which are optionally substituted. The anthraquinone carbazole, anthraquinone oxazole, benzanthrone acridone, dibenzanthrone, flavanthrone, indigo, imidazole, indanthrone, isodibenzanthrone, perylene tetracarboxylic diimide, pyranthrone, triazinylaminoanthraquinone, or violanthrone dye and the one or more optional mono-, di- or polycyclic aromatic or polycyclic heteroaromatic compound substituents thereof may optionally be substituted with one or more functional groups or substituents, wherein each functional group or substituent is selected from the group consisting of halogen; sulfo; sulfonato; sulfamino; sulfanyl; thiol, amino; amido; nitro; azo; imino; carboxy; cyano; formyl; hydroxy; halocarbonyl; carbamoyl; carbamidoyl; phosphonato; phosphonyl; $C_{1-18}$ -alkyl; $C_{1-18}$-alkenyl; $C_{1-18}$-alkynyl; $C_{1-18}$-alkoxy; $C_{1-18}$-oxycarbonyl; $C_{1-18}$-oxoalkyl; $C_{1-18}$-alkyl sulfanyl; $C_{1-18}$-alkyl sulfonyl; $C_{1-18}$-alkyl imino or amino which is substituted with one, two or three $C_{1-18}$-alkyl groups. All $C_{1-18}$-alkyl, $C_{1-18}$-alkenyl and $C_{1-18}$-alkynyl groups may be mono-, di or poly-substituted by any of the proceeding functional groups or substituents. For examples of vat dyes, see the *Colour Index International,* 3rd Edition, Society of Dyers and Colourists, CD-ROM version, AATCC Box 12215, Research Triangle Park, N.C.

In the methods of the present invention, the vat dye may be any vat dye. Vat dyes are commercially available in the form of liquids, granules, or dedusted powders. Vat dyes are also available as pastes and in pre-reduced or solubilized leuco sulfuric ester forms, e.g., Indigosol O, C.I. Solublized Vat Blue (David R. Waring and Goeffrey Hallas (editors), *The Chemistry and Application of Dye,* Plenum Press, New York, 1990, pp. 235–236).

In a preferred embodiment, the vat dye is indigo or a derivative thereof, Vat Black, Vat Blue, Vat Brown, Vat Green, Vat Orange, Vat Red, Vat Violet, or Vat Yellow. Examples of these vat dyes include, but are not limited to, Vat Black 8, Vat Black 9, Vat Black 25, Vat Black 27, Vat Blue 1, Vat Blue 2, Vat Blue 3, Vat Blue 4, Vat Blue 5, Vat Blue 6, Vat Blue 7, Vat Blue 8, Vat Blue 9, Vat Blue 10, Vat Blue 11, Vat Blue 12, Vat Blue 13, Vat Blue 14, Vat Blue 15, Vat Blue 16, Vat Blue 18, Vat Blue 19, Vat Blue 20, Vat Blue 21, Vat Blue 22, Vat Blue 25, Vat Blue 26, Vat Blue 28, Vat Blue 29, Vat Blue 30, Vat Blue 31, Vat Blue 32, Vat Blue 33, Vat Blue 35, Vat Blue 36, Vat Blue 37, Vat Blue 40, Vat Blue 41, Vat Blue 42, Vat Blue 43, Vat Blue 47, Vat Blue 48, Vat Blue 64, Vat Blue 66, Vat Blue 72, Vat Blue 74, Vat Brown 1, Vat Brown 3, Vat Brown 9, Vat Brown 14, Vat Brown 16, Vat Brown 22, Vat Brown 31, Vat Brown 44, Vat Green 1, Vat Green 2, Vat Green 3, Vat Green 6, Vat Green 8, Vat Green 9, Vat Green 11, Vat Green 12, Vat Green 13, Vat Orange 2, Vat Orange 7, Vat Orange 9, Vat Orange 11, Vat Orange 15, Vat Orange 18, Vat Red 10, Vat Red 13, Vat Red 14, Vat Red 15, Vat Red 20, Vat Red 23, Vat Red 32, Vat Red 35, Vat Red 42, Vat Violet 1, Vat Violet 9, Vat Violet 10, Vat Violet 24, Vat Yellow 1, Vat Yellow 6, Vat Yellow 10, Vat Yellow 21, and Vat Yellow 46.

Conversion of an insoluble vat dye to a water-soluble enolate leuco compound generally involves the reduction of the keto groups of the vat dye in the presence of a strong reduction agent and sodium hydroxide to form the sodium enolate leuco compound. The process of converting the water-insoluble vat dye to the soluble leuco form is known as vatting. Since the leuco potential of vat dyes lies between −650 mV and −1000 mV as measured with a calomel electrode, it is important that the reducing agent has a reduction potential in the same range or a more negative reduction potential (see, for example. Alan Johnson (editor), *The Theory of Coloration and Textiles,* Second Edition, Society of Dyers and Colourists, 1989). The most important reducing agent in vat dyeing is sodium dithionite, which is also known as hydrosulphite or hydros, since it has a reduction potential that is sufficiently negative for all practical requirements. Other reducing agents of limited use include, but are not limited to, hydroxyalkylsulphinates, thiourea dioxide, sodium borohydride, and cathodic reduction.

The reduction of a vat dye may be accomplished using any method well known in the art. For example, to prepare a satisfactory vat it is necessary to have an adequate amount of reducing agent and caustic soda. The quantity of reducing agent will vary depending on the particular dye (number of reducible groups, relative molecular mass, content of the pure dye), the temperature, the specific surface area of the dye liquor, the agitation of the liquor, and the amount of air present in the dyeing process. Since sodium hydroxide is consumed both in the vatting process and by the action of atmospheric oxygen, the alkali concentration must be adjusted so the pH of the liquor remains sufficiently high during the dyeing process to prevent formation of the insoluble enolic acid leuco compound. The amount of caustic soda required is determined by the number of keto groups that have to be reduced and by the extent of oxidation due to atmospheric oxygen. Approximately 1 ml of caustic soda (27% by weight) is consumed in the oxidation of 1 g of sodium dithionite. For further details see, for example, John Shore (editor), *Colorants and Auxiliaries,* Volume 2, Society of Dyers and Colourists, 1990.

Sulfurized vat dyes have features in common with both vat and sulfur dyes (David R. Waring and Goeffrey Hallas (editors), *The Chemistry and Application of Dye,* Plenum Press, New York, 1990). Sulfurized vat dyes are produced from dye intermediates by a thionation process similar to that used in the preparation of sulfur dyes (see below), however, they are applied by the vatting process using dithionite. Vat Blue 43 is an example of a sulfurized vat dye. To prepare C.I. Vat blue 43, the p-(3-carbazolylamino) phenol intermediate is refluxed with a solution of sodium polysilfide in butanol, then heated with sodium nitrite, distilled to drive off the butanol, and precipitated by the addition of air and salt (*Colour Index International,* $3_{rd}$ Edition, Society of Dyers and Colourists, CD-ROM version, AATCC Box 12215, Research Triangle Park, N.C., p. 4497).

Apart from the reducing agents, other chemicals may be necessary to insure satisfactory dyeing with vat dyes. These chemicals may include caustic soda to maintain a pH of 12–13 to prevent the formation of insoluble enolic acid leuco compound; neutral salts to increase the substantivity of the leuco dye for the fiber; nonionic agents to form complexes with the leuco dyes to improve the levelness of the dyeings (e.g., alkoxylated types) or to partially strip faulty dyeings (e.g., polyvinylpyrrolidone); a wetting agent to emulsify waxes of the material and insure satisfactory penetration of the dye liquor into the material; a sequestering agent to chelate alkaline-earth ions contained in the material and process water (e.g., sodium hexametaphosphate or EDTA); a dispersing agent to prevent the aggregation of undissolved particles; and anionic polymeric inhibitors to prevent pigment migration in the drying operation.

Sulfur dyes are a large class of synthetic dyes obtained by treating aromatic compounds containing nitro and/or amino groups, e.g., aminophenols, with sulfur and/or sodium polysulfide at high temperature in the absence (baked dyes) or presence of solvent (boiled dyes), such as water or ethanol. In general, sulfur dyes can be described as water-insoluble macromolecules containing sulfur both as an integral part of the chromophore and in attached disulfide bonds between aromatic residues. Sulfur dyes are also water-insoluble and can be applied to a material only in the reduced state.

The most common structural element in the baked sulfur dyes is the benzothiazole group. Most of the baked dyes are yellow, orange, or brown.

The boiled sulfur dyes are blue, green, violet, and black, and most are derivatives of phenylthiazones, phenazones, and phenoxanes.

In the methods of the present invention, the sulfur dye may be any sulfur dye. Sulfur dyes are commercially available in the form of powders, pre-reduced powders, grains, dispersed powders, dispersed pastes, or liquids.

In a preferred embodiment, the sulfur dye is a benzothiazole, phenylthiazone, phenazone, or phenoxane dye, each of which is optionally substituted with one or more mono-, di- or polycyclic aromatic or polycyclic heteroaromatic compounds. Examples of such mono-, di- or polycyclic aromatic or heteroaromatic compounds include, but are not limited to, an acridine, anthracene, azulene, benzene, benzofurane, benzothiazole, benzothiazoline, carboline, carbazole, cinnoline, chromane, chromene, chrysene, fulvene, furan, imidazole, indazole, indene, indole, indoline, indolizine, isothiazole, isoquinoline, isoxazole, naphthalene, naphthylene, naphthylpyridine, oxazole, perylene, phenanthrene, phenazine, phtalizine, pteridine, purine, pyran, pyrazole, pyrene, pyridazine, pyridazone, pyridine, pyrimidine, pyrrole, quinazoline, quinoline, quinoxaline, sulfonyl, thiophene, and triazine, each of which are optionally substituted. The benzothiazole, phenylthiazone, phenazone, or phenoxane dye and the one or more optional mono-, di- or polycyclic aromatic or polycyclic heteroaromatic compound substituents thereof, may optionally be substituted with one or more functional groups or substituents, wherein each functional group or substituent is selected from the group consisting of halogen; sulfo; sulfonato; sulfamino; sulfanyl; thiol, amino; amido; nitro; azo; imino; carboxy; cyano; formyl; hydroxy; halocarbonyl; carbamoyl; carbamidoyl; phosphonato; phosphonyl; $C_{1-18}$- alkyl; $C_{1-18}$-alkenyl; $C_{1-18}$-alkynyl; $C_{1-18}$-alkoxy; $C_{1-18}$-oxycarbonyl; $C_{1-18}$-oxoalkyl; $C_{1-18}$-alkyl sulfanyl; $C_{1-18}$-alkyl sulfonyl; $C_{1-18}$-alkyl imino or amino which is substituted with one, two or three $C_{1-18}$-alkyl groups. All $C_{1-18}$-alkyl, $C_{1-18}$-alkenyl and $C_{1-18}$-alkynyl groups may be mono-, di or poly-substituted by any of the proceeding functional groups or substituents. For examples of sulfur dyes, see the *Colour Index International,* $3_{rd}$ Edition, supra.

In a preferred embodiment, the sulfur dye is Sulfur Black, Sulfur Blue, Sulfur Brown, Sulfur Green, Sulfur Orange, Sulfur Violet, or Sulfur Yellow. Examples of these sulfur dyes include, but are not limited to, Sulfur Black 1, Sulfur Black 2, Sulfur Black 4, Sulfur Black 11, Sulfur Blue 9, Sulfur Blue 13, Sulfur Blue 14, Sulfur Brown 1, Sulfur Brown 8, Sulfur Brown 10, Sulfur Brown 52, Sulfur Green 2, Sulfur Green 3, Sulfur Green 7, Sulfur Green 10, Sulfur Green 14, Sulfur Orange 1, Sulfur Red 5, Sulfur Red 6, Sulfur Red 10, Sulfur Violet 1, and Sulfur Yellow 4.

The conversion of an insoluble sulfur dye to a soluble dye generally involves the reduction of the disulfide groups of the sulfur dye. Since the reduction potential of sulfur dyes is −400 mV to −500 mV, milder reducing agents than those used in vat dyeing may be used ( see, for example. Alan Johnson (editor), *The Theory of Coloration and Textiles,* Second Edition, Society of Dyers and Colourists, 1989). Sodium sulfide has been the traditional reducing agent with sulfur dyes, but sodium hydrosulfide is more widely used. Other reducing agents include, but are not limited to, caustic soda/sodium dithionite, sodium carbonate/sodium dithionite, glucose, thioglycol, hydroxyacetone, thiourea dioxide, and cathodic reduction.

The color fastness of sulfur dyes depends greatly on the reduction conditions since over-reduction of the dye may result in low color yields and/or off-shades. The sulfur dyes are very fast to light and washing, but not to chlorine. They are used mainly to dye cotton and other plant fibers in a sodium sulfide bath. A subsequent treatment with metal salts can improve the quality of the dyeing.

The reduction of a sulfur dye may be accomplished using any method known in the art (see, for example, David R. Waring and Goeffrey Hallas (editors), *The Chemistry and Application of Dye,* Plenum Press, New York, 1990, pp. 287–309; and Henrich Zollinger, *Color Chemistry,* VCH Publishers, Inc., New York, 1991, pp. 232–236). The sulfur dye is generally dissolved by boiling for several minutes in a reducing solution (e.g., sodium sulfide) or by vatting with caustic soda and sodium dithionite in a similar manner to vat dyes. See, for example, John Shore (editor), *Colorants and Auxiliaries,* Volume 2, Society of Dyers and Colourists, 1990; and John Shore (editor), *Cellulosics Dyeing,* Society of Dyers and Colourists, West Yorkshire, England, 1995.

Apart from the reducing agents, other chemicals as described above for vat dyes may be necessary to insure satisfactory dyeing with sulfur dyes. In addition to the chemicals described above, fixative additives may be used to improve color fastness (e.g., epichlorohydrin derivatives).

In the methods of the present invention, the application of a reduced vat and/or sulfur dye(s) to a material generally involves three steps. The phrase "dyeing of a material" will be understood to encompass the printing of a material with such dyes.

In the first step, the dyeing of the material occurs by moving the material through a stationary bath, by pumping the reduced dye bath through the material, or having both the material and dye liquor mixed together. Examples of the equipment that may be used in these processes are described by Tindall, 1996, *Journal of the Textile Association* 57: 27–34, and John Shore (editor), *Cellulosics Dyeing,* Society of Dyers and Colourists, West Yorkshire, England, 1995.

In the second step, the reduced vat and/or sulfur dye adsorbs onto and diffuses into the material. The substantivity of the reduced dye toward the material can be attributed to the ion-dipole and dispersion forces operating between the dye ion and the material. The rate of penetration is determined by the diffusion coefficient, D, which increases with temperature. At higher temperatures, the material tends to become more flexible increasing the free volume.

In the final step, the reduced dye is fixed or trapped in the fiber by enzymatic oxidation of the reduced dye to its original oxidized insoluble colored form. Following washing and drying of the dyed material, the CIELAB values can then be measured using an instrument suited for such purposes. The parameters "L", "a", and "b" are used to quantify color and are well known to persons of ordinary skill in the art of color science. See, for example, Billmeyer and Saltzman, *Principles of Color Technology,* Second Edition, John Wiley & Sons, New York, 1981, page 59.

Following the dyeing of the material according to the methods of the present invention, the dyed material may then be further processed according to standard techniques known in the art, e.g., after-soaping, drying, etc., prior to the material's intended use such as in garments.

There is no standard dyeing process in the art since the procedure will depend on the available equipment, material, amount of material, and actual dye(s). The dyeing process may be batchwise, semi-continuous, or continuous. For examples of various procedures, see John Shore (editor), *Cellulosics Dyeing,* Society of Dyers and Colourists, West Yorkshire, England, 1995; David R. Waring and Goeffrey Hallas (editors), *The Chemistry and Application of Dye,* Plenum Press, New York, 1990; *Textile Chemist and Colorist* 12: 38–39; Perkins, 1991, *Textile Chemist and Colorist* 23: 23–27; and Tigler, 1980, *Textile Chemist and Colorist* 6: 43–44.

The material dyed by the methods of the present invention is a fabric, yam, fiber, garment or film. Preferably, the material is made of cotton, diacetate, flax, fur, hide, leather, linen, lyocel, polyacrylic, polyamide (e.g., nylon), polyester, ramie, rayon, silk, tencel, triacetate, viscose or wool.

The dye liquor, which comprises the material, used in the methods of the present invention may have a liquor/material ratio in the range of about 0.5:1 to about 200:1, preferably about 0.6:1 to about 20:1.

The concentration of reduced dye in the dye liquor will depend on the material being dyed, the dye, and the amount of material being dyed. Determining the amount of dye is well within the skilled art. See, for example, John Shore (editor), *Cellulosics Dyeing,* Society of Dyers and Colourists, West Yorkshire, England, 1995; David R. Waring and Goeffrey Hallas (editors), *The Chemistry and Application of Dye,* Plenum Press, New York, 1990; and Henrich Zollinger, *Color Chemistry,* VCH Publishers, Inc., New York, 1991.

The dye adsorption and diffusion step in a continuous process can be performed at a temperature in the range of about 15° C. to about 55° C., preferably about 15° C. to about 45° C., preferably about 15° C. to about 35° C., more preferably about 15° C. to about 30° C., and most preferably about 15° C. to about 25° C., and at a pH in the range of about 9 to about 13, preferably about 10 to about 13, more preferably about 11 to about 13, and most preferably about 12 to about 13 for a period of about 20 seconds to about 10 minutes, preferably about 25 seconds to about 5 minutes, more preferably about 30 seconds to about 2 minutes, and most preferably about 30 seconds to 1 minute.

The dye adsorption and diffusion step in a batch process can be performed at a temperature in the range of about 20° C. to about 115° C., preferably about 30° C. to about 100° C., preferably about 40° C. to about 90° C., more preferably about 45° C. to about 80° C., and most preferably about 50° C. to about 80° C., and at a pH in the range of about 9 to about 13, preferably about 10 to about 13, more preferably about 11 to about 13, and most preferably about 12 to about 13 for a period of about 10 minutes to about 90 minutes, preferably about 10 minutes to about 80 minutes, more preferably about 10 minutes to about 70 minutes, and most preferably about 10 minutes to about 60 minutes.

According to the methods of the present invention, the one or more reduced vat dyes and/or one or more reduced sulfur dyes are oxidized to their original oxidized insoluble colored forms with an oxidation system comprising (a) an oxygen source and one or more enzymes exhibiting oxidase activity and/or (b) a hydrogen peroxide source and one or more enzymes exhibiting peroxidase activity. The enzymatic oxidation step also serves to fix the dye to the material.

Enzymes exhibiting oxidase activity are preferably copper oxidases (e.g., blue copper oxidases), which include, but are not limited to, bilirubin oxidase (EC 1.3.3.5), catechol oxidase (EC 1.10.3.1), laccase (EC 1.10.3.2), o-aminophenol oxidase (EC 1.10.3.4), polyphenol oxidase (EC 1.10.3.2), ascorbate oxidase (EC 1.10.3.3), and ceruloplasmin. Enzymes exhibiting peroxidase activity include, but are not limited to, peroxidase (EC 1.11.1.7) and haloperoxidase, e.g., chloro- (EC 1.11.1.10), bromo- (EC 1.11.1) and iodoperoxidase (EC 1.11.1.8). Assays for determining the activity of these enzymes are well known to persons of ordinary skill in the art.

When the one or more enzymes employed in the invention are oxidases, an oxygen source, e.g., air, must be used. Oxygen can be supplied by simply aerating the solution containing the material being dyed.

When the one or more enzymes employed in the invention are peroxidases, a hydrogen peroxide source, e.g., hydrogen peroxide itself, must be used. The hydrogen peroxide source may be added at the beginning or during the process, e.g., in an amount of 0.001–5 mM, particularly 0.01–1 mM.

One source of hydrogen peroxide includes precursors of hydrogen peroxide, e.g., a perborate or a percarbonate. Another source of hydrogen peroxide includes enzymes which are able to convert molecular oxygen and an organic or inorganic substrate into hydrogen peroxide and the oxidized substrate, respectively. These enzymes produce only low levels of hydrogen peroxide, but they may be employed to great advantage in the process of the invention as the presence of peroxidase ensures an efficient utilization of the hydrogen peroxide produced. Examples of enzymes which are capable of producing hydrogen peroxide include, but are not limited to, glucose oxidase, urate oxidase, galactose oxidase, alcohol oxidase, amine oxidase, amino acid oxidase, and cholesterol oxidase.

The laccase(s) may be a plant, microbial, insect, or mammalian laccase.

In a preferred embodiment, the laccase(s) is a plant laccase. For example, the laccase may be a lacquer, mango, mung bean, peach, pine, poplar, prune, sycamore, or tobacco laccase.

In another preferred embodiment, the laccase(s) is an insect laccase. For example, the laccase may be a Bombyx, Calliphora, Diploptera, Drosophila, Lucilia, Manduca, Musca, Oryctes, Papilio, Phorma, Rhodnius, Sarcophaga, Schistocerca, or Tenebrio laccase.

The laccase(s) is preferably a microbial laccase, such as a bacterial or a fungal laccase.

In another preferred embodiment, the laccase(s) is a bacterial laccase. For example, the laccase may be an Acetobacter, Acinetobacter, Agrobacterium, Alcaligenes, Arthrobacter, Azospirillum, Azotobacter, Bacillus, Comamonas, Clostridium, Gluconobacter, Halobacterium, Mycobacterium, Rhizobium, Salmonella, Serratia, Streptomyces, *E. coli,* Pseudomonas, Wolinella, or methylotrophic bacterial laccase.

In a more preferred embodiment, the laccase(s) is an *Azospirillum lipoferum* laccase.

In another preferred embodiment, the laccase(s) is a fungal laccase. For example, the laccase(s) may be a yeast laccase such as a Candida, Kluyveromyces, Pichia, Saccharomyces, Schizosaccharomyces, or Yarrowia laccase; or a filamentous fungal laccase such as an Acremonium, Agaricus, Antrodiella, Armillaria, Aspergillus, Aureobasidium, Bjerkandera, Botrytis, Cerrena, Chaetomium, Chrysosporium, Collybia, Coprinus, Cryptococcus, Cryphonectria, Curvularia, Cyathus, Daedalea, Filibasidium, Fomes, Fusarium, Geotrichum, Halosarpheia, Humicola, Junghuhnia, Lactarius, Lentinus, Magnaporthe, Monilia, Monocillium, Mucor, Myceliophthora, Neocallimastix, Neurospora, Paecilomyces, Panus, Penicillium, Phanerochaete, Phellinus, Phlebia, Pholiota Piromyces, Pleurotus, Podospora, Pycnoporus, Polyporus (Trametes), Pyricularia, Rhizoctonia, Rigidoporus, Schizophyllum, Sclerotium, Scytalidium, Sordaria, Sporotrichum, Stagonospora, Talaromyces, Thermoascus, Thielavia, Tolypocladium, or Trichoderma laccase.

In a more preferred embodiment, the laccase(s) is a *Coprinus cinereus, Humicola brevis* var. *thermoidea, Humicola brevispora, Humicola grisea* var. *thermoidea, Humicola insolens,* and *Humicola lanuginosa* (also known as *Thermomyces lanuginosus*), *Myceliophthora thermophila, Myceliophthora vellerea, Polyporus alveolaris, Polyporus arcularius, Polyporus australiensis, Polyporus badius, Polyporus biformis, Polyporus brumalis, Polyporus ciliatus, Polyporus colensoi, Polyporus eucalyptorum, Polyporus meridionalis, Polyporus palustris, Polyporus pinsitus* (also known as *Trametes villosa*), *Polyporus rhizophilus, Polyporus rugulosus, Polyporus squamosus, Polyporus tuberaster, Polyporus tumulosus, Polyporus varius, Polyporus versicolor. Polyporus zonatus, Pycnoporus cinabarinus, Rhizoctonis praticola, Rhizoctonia solani, Scytalidium acidophilum, Scytalidium album, Scytalidium aurantiacum, Scytalidium circinatum, Scytalidium flaveobrunneum, Scytalidium hyalinum, Scytalidium indonesiacum, Scytalidium lignicola, Scytalidium thermophilum, Scytalidium uredinicolum,* or *Torula thermophila* laccase. The laccase(s) may also be a modified laccase by at least one amino acid residue in or near the copper sites, wherein the modified oxidase possesses an altered pH and/or specific activity relative to the wild-type oxidase. For example, the modified laccase(s) could be modified in segment (a) of the Type 1 copper site.

The peroxidase(s) may be a plant, microbial, insect, or mammalian peroxidase.

In a preferred embodiment, the peroxidase(s) is a plant peroxidase. For example, the peroxidase may be a horseradish peroxidase.

The peroxidase(s) is preferably a microbial peroxidase, such as a bacterial or a fungal peroxidase.

In another preferred embodiment, the peroxidase(s) is a bacterial peroxidase. For example, the peroxidase may be a Bacillus, Pseudomonas, Rhodobacter, Rhodomonas, Streptococcus, Streptomyces, or Streptoverticillum peroxidase.

In a more preferred embodiment, the peroxidase(s) is a *Bacillus pumilus* (ATCC 12905), *Bacillus stearothennophilus, Pseudomonas fluorescens* (NRRL B-11), *Pseudomonas purrocinia* (ATCC 15958), *Rhodomonas palustri, Rhodobacter sphaeroides, Streptococcus lactis, Streptomyces spheroides* (ATTC 23965), *Streptomyces thermoviolaceus* (IFO 12382), or *Streptoverticillum verticillium* ssp. *verticillium* peroxidase.

In another preferred embodiment, the peroxidase(s) is a fungal peroxidase. For example, the peroxidase may be a yeast peroxidase such as a Candida, Kluyveromyces, Pichia, Saccharomyces, Schizosaccharomyces, or Yarrowia peroxidase; or a filamentous fungal peroxidase such as an Arthromyces, Caldariomyces, Cladosporium, Coprinus, Coriolus, Dreschlera, Embellisia, Fusarium, Humicola, Mucor, Myrothecium, Phanerochaete, Rhizopus, Trametes, Trichoderma, Ulocladium, or Verticillum peroxidase.

In a more preferred embodiment, the peroxidase(s) is an *Arthromyces ramosus* (FERM P-7754), *Caldariomyces fumago, Coprinus cinereus* f. *microsporus* (IFO 8371), *Coprinus macrorhizus, Coriolus versicolor* (e.g., PR4 28-A), *Dreschlera halodes, Embellisia alli, Fusarium oxysporum* (DSM 2672), *Humicola insolens, Mucor hiemalis, Myrothecium verrucana* (IFO 6113), *Phanerochaete chrysosporium* (e.g., NA-12), *Trichoderma resii, Ulocladium chartarum, Verticillum alboatrum,* or *Verticillum dahlie* peroxidase.

Other potential sources of peroxidases are listed in B. C. Saunders et al., op. cit., pp. 41–43.

Methods for producing enzymes to be used in the methods of the present invention are described in the art, e.g., *FEBS Letters* 1625, 173(1), *Applied and Environmental Microbiology,* February 1985, pp. 273–278, *Applied Microbiol. Biotechnol.* 26, 1987, pp. 158–163, *Biotechnology Letters* 9(5), 1987, pp. 357–360, *Nature* 326, 2 April 1987, *FEBS Letters* 4270, 209(2), p. 321, EP 179 486, EP 200 565, GB 2 167 421, EP 171 074, and *Agric. Biol. Chem.* 50(1), 1986, p. 247.

Particularly preferred enzymes are those which are active at a pH in the range of about 2.5 to about 12.0, preferably in the range of about 4 to about 10, most preferably in the range of about 4.0 to about 7.0 and in the range of about 7.0 to about 10.0. Such enzymes may be isolated by screening for the relevant enzyme production by alkalophilic microorganisms, e.g., using the 2,2'-azinobis-(3-ethylbenzothiazoline-6-sulfonic acid) assay described in Childs and Bardsley, 1975, *Biochem. J.* 145: 93–103.

Other preferred enzymes are those which exhibit a good thermostability as well as a good stability towards commonly used dyeing additives such as non-ionic, cationic, or anionic surfactants, chelating agents, salts, polymers, etc.

The enzymes may also be produced by a method comprising cultivating a host cell transformed with a recombinant DNA vector which carries a DNA sequence encoding said enzyme as well as DNA sequences encoding functions permitting the expression of the DNA sequence encoding the enzyme, in a culture medium under conditions conducive for expression of the enzyme and recovering the enzyme from the culture.

A DNA fragment encoding the enzyme may, for instance, be isolated by establishing a cDNA or genomic library of a microorganism producing the enzyme of interest, such as one of the organisms mentioned above, and screening for positive clones by conventional procedures such as by hybridization to nucleic acid probes synthesized on the basis of the full or partial amino acid sequence of the enzyme, or by selecting for clones expressing the appropriate enzyme activity, or by selecting for clones producing a protein which is reactive with an antibody against the native enzyme.

Once selected, the DNA sequence may be inserted into a suitable replicable expression vector comprising appropriate promoter, operator and terminator sequences permitting the enzyme to be expressed in a particular host organism.

The resulting expression vector may then be transformed into a suitable host cell, such as a fungal cell, preferred examples of which are species of Aspergillus, most preferably *Aspergillus oryzae* and *Aspergillus niger,* and species of Fusarium, most preferably *Fusarium venenatum.* Fungal cells may be transformed by a process involving protoplast formation and transformation of the protoplasts followed by regeneration of the cell wall in a manner known per se. The use of Aspergillus as a host microorganism is described in EP 238,023 (of Novo Industri A/S). The use of Fusarium as a host microorganism is described in WO 96/00787 and WO 97/08325.

Alternatively, the host organisms may be a bacterium, in particular strains of Bacillus, Pseudomonas, Streptomyces, or *E. coli.* The transformation of bacterial cells may be performed according to conventional methods, e.g., as described in T. Maniatis et al., *Molecular Cloning: A Laboratory Manual,* Cold Spring Harbor, 1982.

The screening of appropriate DNA sequences and construction of vectors may also be carried out by standard procedures, cf. T. Maniatis et al., op. cit.

The medium used to cultivate the transformed host cells may be any conventional medium suitable for growing the host cells in question. The expressed enzyme may conveniently be secreted into the culture medium and may be recovered therefrom by well-known procedures including separating the cells from the medium by centrifugation or filtration, precipitating proteinaceous components of the medium by means of a salt such as ammonium sulphate, followed by chromatographic procedures such as ion exchange chromatography, affinity chromatography, or the like.

The amount of enzyme(s) used in the oxidation step and especially when a chemical mediator is present as well as the conditions employed are critical in the methods of the present invention in order to avoid bleaching of the dye or converting the dye to a different color with the enzymatic oxidation system.

The amount of enzyme(s) used in the oxidization step should be in an amount effective to achieve an efficient diffusion rate such that substantially all of the material (generally greater than about 70%, preferably greater than about 80%, more preferably greater than about 90%, and most preferably greater than about 95%) comes into contact with the enzyme(s). Determining a sufficient amount of the enzyme(s) is well within the skilled art. The amount of enzyme(s) is generally in the range from about 0.001% to about 50%, preferably from about 0.01% to about 25%, and more preferably from about 0.1% to about 10% enzyme protein per dry weight of dye.

If the pH of the dye liquor is not compatible with the optimal activity of the enzyme(s), the liquor may need to be pH adjusted particularly before addition of the enzyme(s). The need for pH adjustment may not be necessary, especially if the enzyme(s) has optimal activity compatible with the pH of the liquor.

The enzymatic oxidation step can be performed at a temperature in the range of about 5° C. to about 120° C., preferably in the range of about 5° C. to about 80° C., and more preferably in the range of about 15° C. to about 70° C., and a pH in the range of about 2.5 to about 12, preferably between about 4 and about 10, and more preferably in the range of about 4.0 to about 7.0 or in the range of about 7.0 to about 10.0 for a period of preferably about 0.1 minute to about 60 minutes, more preferably about 0.1 minute to about 30 minutes even more preferably about 0.1 minute to about 15 minutes, and most preferably about 0.2 minutes to about 5 minutes. Preferably, a temperature and pH near the temperature and pH optima of the enzyme, respectively, are used.

In a preferred embodiment, the enzymatic oxidation system further comprises one or more chemical mediator agents which enhance the activity of the enzyme exhibiting peroxidase activity or the enzyme exhibiting oxidase activity. The term "chemical mediator" is defined herein as a chemical compound which acts as a redox mediator to effectively shuttle electrons between the enzyme exhibiting peroxidase activity or the enzyme exhibiting oxidase activity and the dye. Chemical mediators are also known as enhancers and accelerators in the art.

The chemical mediator may be a phenolic compound, for example, methyl syringate. The chemical mediator may also be an N-hydroxy compound, an N-oxime compound, or an N-oxide compound, for example, N-hydroxybenzotriazole, violuric acid, or N-hydroxyacetanilide. The chemical mediator may also be a phenoxazine/phenathiazine compound, for example, phenathiozine-10-propionate. The chemical mediator may further be 2,2'-azinobis-(3-ethylbenzothiazoline-6-sulfonic acid) (ABTS). Other chemical mediators are well known in the art. For example, the organic chemical compounds disclosed in WO 95/01426 are known to enhance the activity of a laccase. Furthermore, the chemical compounds disclosed in WO 94/12619 and WO 94/12621 are known to enhance the activity of a peroxidase.

The chemical mediator is added to the dye liquor in an amount of about 0.5% to about 100%, preferably in an amount of about 1% to about 75%, preferably in an amount of about 1% to about 50%, more preferably in an amount of about 1% to about 25%, and most preferably in an amount of about 1% to about 5% dry weight of mediator per dry amount of dye.

When a chemical mediator is included in the oxidation step, the oxidation can be performed at a temperature in the range of about 5° C. to about 120° C., preferably in the range of about 5° C. to about 80° C., and more preferably in the range of about 15° C. to about 70° C., and a pH in the range of about 2.5 to about 12, preferably between about 4 and about 10, and more preferably in the range of about 4.0 to about 7.0 or in the range of about 7.0 to about 10.0 for a period of preferably about 0.1 minute to about 60 minutes, more preferably about 0.1 minute to about 30 minutes, even more preferably about 0.1 minute to about 15 minutes, and most preferably about 0.2 minutes to about 5 minutes.

In the methods of the present invention, combinations of chemical mediators may be used for oxidizing two or more reduced vat and/or sulfur dyes, particularly where the presence of different reduced dyes may require different oxidases and/or peroxidases with different substrate specificities.

The oxidation system used in the methods of the present invention may further comprise a mono- or divalent ion which includes, but is not limited to, sodium, potassium, calcium and magnesium ions (0 to 3 M, preferably 25 mM to 1 M), a polymer which includes, but is not limited to, polyvinylpyrrolidone, polyvinylalcohol, polyaspartate, polyvinylamide, polyethylene oxide (0–50 g/l, preferably 1–500 mg/l) and a surfactant (10 mg-5 g/l).

Examples of such surfactants are anionic surfactants such as carboxylates, for example, a metal carboxylate of a long chain fatty acid; N-acylsarcosinates; mono or di-esters of phosphoric acid with fatty alcohol ethoxylates or salts of such esters; fatty alcohol sulphates such as sodium dodecyl sulphate, sodium octadecyl sulphate or sodium cetyl sulphate; ethoxylated fatty alcohol sulphates; ethoxylated alkylphenol sulphates; lignin sulphonates; petroleum sulphonates; alkyl aryl sulphonates such as alkyl-benzene sulphonates or lower alkylnaphthalene sulphonates, e.g., butyl-naphthalene sulphonate; salts or sulphonated naphthalene-formaldehyde condensates; salts of sulphonated phenol-formaldehyde condensates; or more complex sulphonates such as amide sulphonates, e.g., the sulphonated condensation product of oleic acid and N-methyl taurine or the dialkyl sulphosuccinates, e.g., the sodium sulphonate or dioctyl succinate. Further examples of such surfactants are nonionic surfactants such as condensation products of fatty acid esters, fatty alcohols, fatty acid amides or fatty-alkyl- or alkenyl-substituted phenols with ethylene oxide, block copolymers of ethylene oxide and propylene oxide, acetylenic glycols such as 2,4,7,9-tetraethyl-5-decyn-4,7-diol, or ethoxylated acetylenic glycols. Further examples of such surfactants are cationic surfactants such as aliphatic mono-, di-, or polyamines such as acetates, naphthenates or oleates; oxygen-containing amines such as an amine oxide of polyoxyethylene alkylamine; amide-linked amines prepared by the condensation of a carboxylic acid with a di- or polyamine; or quaternary ammonium salts.

The present invention also relates to dyed materials obtained by the methods of the present invention. The material may be a fabric, yarn, fiber, garment or film made of cotton, diacetate, flax, fur, hide, leather, linen, lyocel, polyacrylic, polyamide, polyester, ramie, rayon, silk, tencel, triacetate, or wool.

The invention is further illustrated by the following non-limiting examples.

EXAMPLES

Materials

Chemicals used as buffers and substrates were commercial products of at least reagent grade. The vat dyes Vat Blue 43 (CI 53630) and Vat Orange 7 (CI 71105) were obtained from C. H. Patrick & Co., Greenville, S.C. The structures of Indigo, Vat Blue 43 and Vat Orange 7 are shown in FIG. 1.

Example 1

Vat Blue 43 Reduction and Reoxidation

Vat Blue 43 at a 0.01% level was reduced with $Na_2S_2O_4$ in Britton & Robinson (B&R) pH 7 buffer at 20° C. for 1 hour. After the reduction, laccase was added to start the reoxidation. Both reactions were monitored on a Shimadzu UV160U spectrophotometer in a 1-cm quartz cuvette. Methyl syringate (MS), 2,2'-azinobis(3-ethylbenzothiazoline-6-sulfonic acid) (ABTS), and phenathiozine-10-propionate (PPT) were tested as chemical mediators. Due to the instability of the $Na_2S_2O_4$ stock solution (0.5 M), the actual initial $Na_2S_2O_4$ concentration in the solution was estimated from the reduction extent of the dye. The reoxidation was studied in solutions in which no excess $Na_2S_2O_4$ was present.

Figure 2:
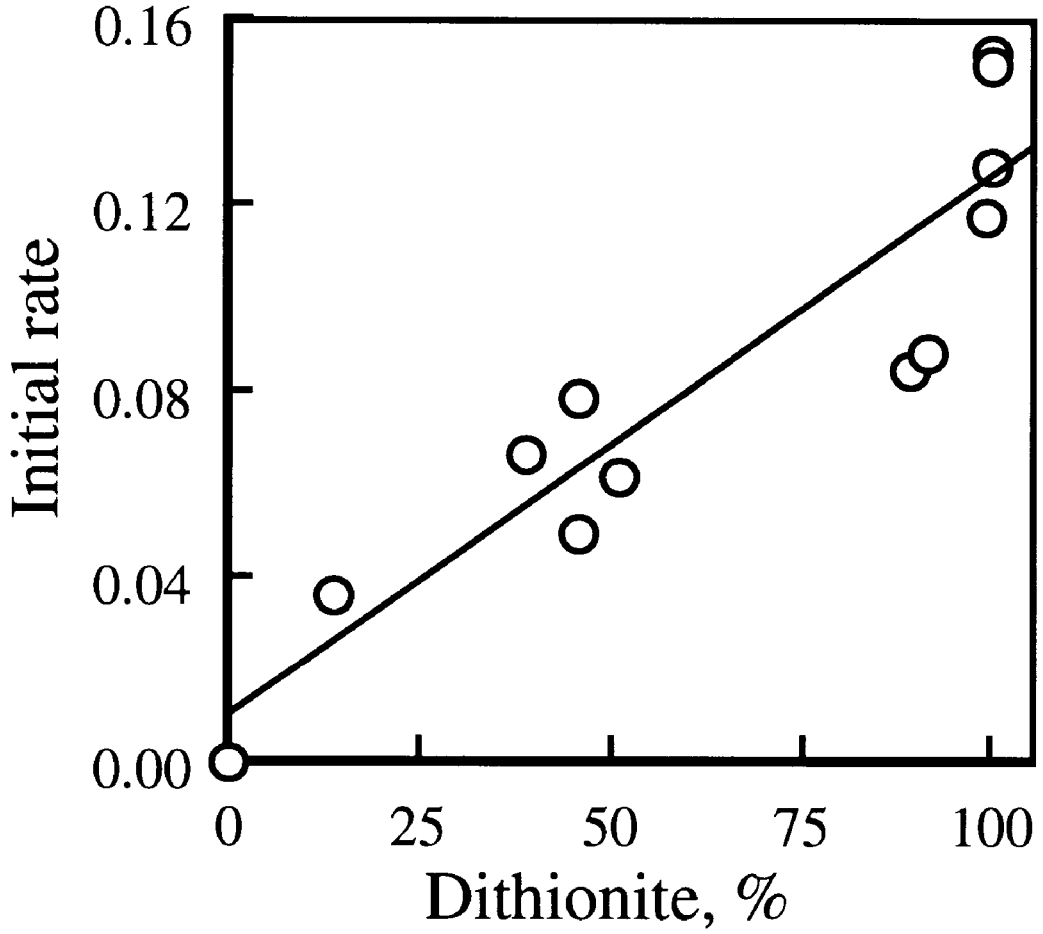
FIG. 2 shows the reduction of 0.01% Vat Blue 43 by $Na_2S_2O_4$ as monitored at 626 nm. The initial rate was expressed in $-\Delta A$/min, and the $Na_2S_2O_4$ concentration was expressed by the corresponding reduction extent of Vat Blue 43. The correlation line is Rate=0.001×[reduced Vat Blue 43]+0.009 ($r^2$=0.842).

Diluted in either deionized water or B&R buffer, Vat Blue 43 yielded a spectrum with maximal absorbance wavelengths ($\lambda_{max}$) at 626 and 289 nm. As measured at 626 nm, the absorbance (A) of Vat Blue 43 obeyed Beer's law (A [Vat Blue 43]) in the testing range of 0.0006–0.06% Vat Blue 43. The reduction of Vat Blue 43 by $Na_2S_2O_4$ led to the bleaching of its blue color and the decrease of $A_{626}$ and the appearance of a new $\lambda_{max}$ at 614 nm (with pseudo-isosbestic points at 411 and 317 nm). The reduced (leuco) Vat Blue 43 had an $A_{626}$ equal to 40% of the initial $A_{626}$ of the "native" Vat Blue 43. The time profile of $\Delta A_{626}$ was of hyperbolic type and as shown in FIG. 2, the initial reduction rate was proportional to the initial concentration of $Na_2S_2O_4$.

Purified recombinant *Myceliophthora thermophila* laccase was obtained as described in WO 95/33836. Laccase activity was determined from the oxidation of syringaldazine under aerobic conditions. The violet color produced was measured spectrophotometrically at 530 nm. The analytical conditions were 19 $\mu$M syringaldazine, 23.2 mM acetate buffer, pH 5.5, 30° C., and 1 minute reaction time. One laccase unit (LACU) is the amount of laccase that catalyzes the conversion of 1 micromole of syringaldazine per minute under these conditions.

Figure 3:
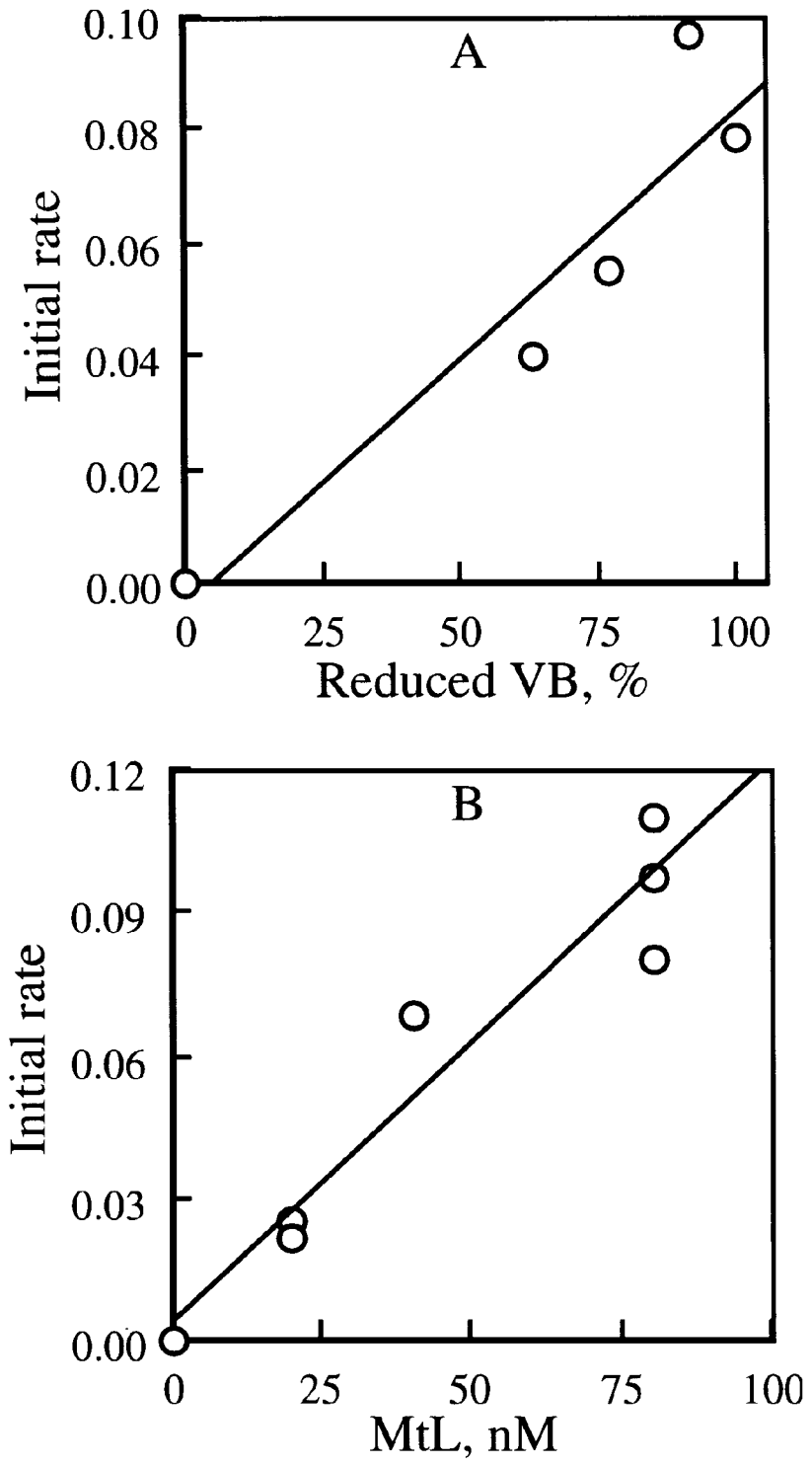
FIG. 3 shows the dependence of the initial reoxidation rate on the concentration of reduced Vat Blue 43 and *Myceliophthora thermophila* laccase. The initial rate was expressed in $\Delta A$/min, and the reduced Vat Blue 43 concentration was expressed as the percentage of the initial Vat Blue 43 concentration. The correlation lines were: (A) Rate=0.001[reduced Vat Blue 43]−0.004 ($r^2$=0.877); (B) Rate=0.001[reduced Vat Blue 43]+0.004 ($r^2$=0.920).

Upon the addition of *Myceliophthora thermophila* laccase, reduced Vat Blue 43 was reoxidized as shown by the appearance of blue color and the increase of $A_{626}$. The time profile of $\Delta A_{626}$ was of hyperbolic type and as shown in FIG. 3, the initial reoxidation rate was proportional to the initial concentration of reduced Vat Blue 43 as well as *Myceliophthora thermophila* laccase. The spectrum of the reoxidized Vat Blue 43 was similar to the initial spectrum of the native Vat Blue 43, except that the absorbance for the former was only about 80% of that for the latter. No significant reoxidation of reduced Vat Blue 43 was observed when the *Myceliophthora thermophila* laccase-storing buffer (10 mM Tris-Cl pH 7.5) was added. The presence of 60 $\mu$M PPT increased the oxidation rate of 20 nM *Myceliophthora thermophila* laccase (0.06 LACU) by two-fold.

Example 2

Vat Orange 7 Reduction and Reoxidation

Vat Orange 7 was reduced with $Na_2S_2O_4$ using the same procedure described in Example 1 for Vat Blue 43.

Figure 4:
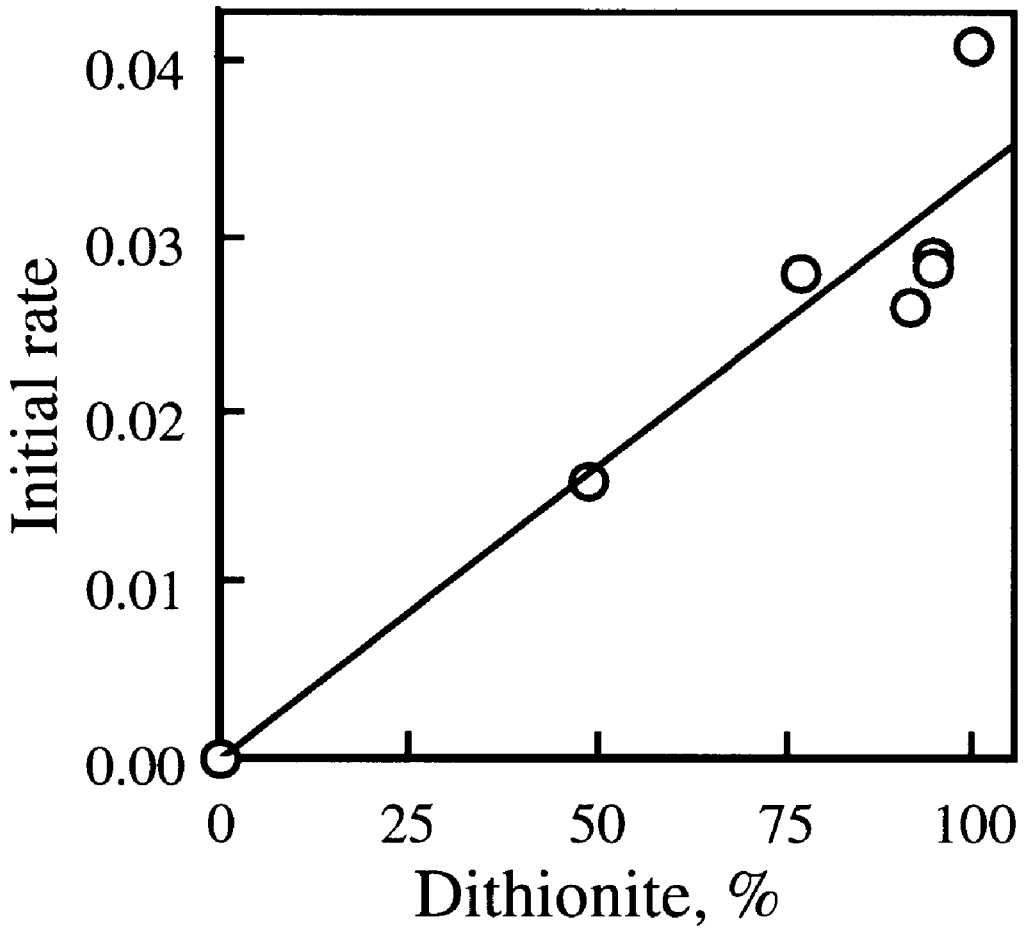
FIG. 4 shows the reduction of 0.01% Vat Orange 7 by $Na_2S_2O_4$ as monitored at 540 nm. The initial rate was expressed in $-\Delta A$/min, and the $Na_2S_2O_4$ concentration was expressed by the corresponding reduction extent of Vat Orange 7. The correlation line was Rate=0.0003×[reduced Vat Orange 7]−0.0003 ($r^2$=0.902).

Diluted in either deionized $H_2O$ or B&R buffer, Vat Orange 7 yielded a spectrum with $\lambda_{max}$ at 540, 500, 457, 434, and 303 nm. The reduction of Vat Orange 7 by $Na_2S_2O_4$ transformed it from orange to a greenish black color. The reduced Vat Orange 7 had $\lambda_{max}$ at 622, 572, 540, 502, 447, and 419 nm (with pseudo-isosbestic points at 566, 458, and 376 nm). The time courses of $A_{540}$ (decrease) and $A_{622}$ (increase) yielded the same kinetic characteristics. The reduced Vat Orange 7 had an $A_{540}$ equal to 49% of the initial $A_{540}$ of Vat Orange 7. As shown in FIG. 4, the initial reduction rate was proportional to the initial concentration of $Na_2S_2O_4$.

Purified recombinant *Coprinus cinereus* peroxidase was obtained as described in WO 97/08325. One peroxidase unit (POXU) is defined as the amount of enzyme that catalyzes the conversion of 1 micromole of hydrogen peroxide per minute under the following conditions: 0.88 mM hydrogen peroxide, 1.67 mM 2,2'-azinobis(3-ethylbenzothiazoline-6-sulfonate), 0.1 M phosphate buffer (containing Triton X405 at 1.5 g per liter), pH 7.0, incubated at 30° C., photometrically followed at 418 nm (extinction coefficient of ABTS is set to 3.6 l/mmol*mm).

Figure 5:
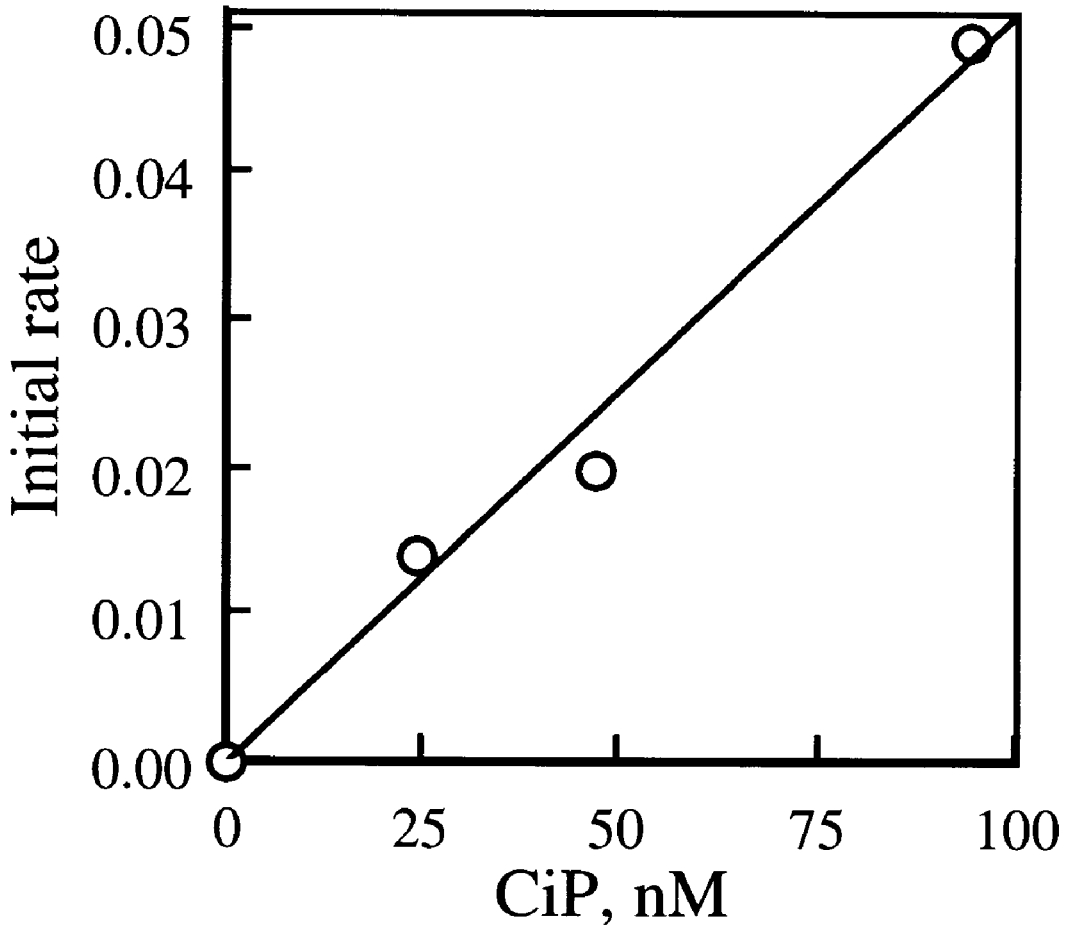
FIG. 5 shows the dependence of the initial reoxidation rate on the concentration of *Coprinus cinereus* peroxidase. The initial rate was expressed in ΔA/min, and the reduced Vat Orange 7 concentration was expressed as the percentage of the initial Vat Orange 7 concentration. The initial $H_2O_2$ concentration was 5.3 mM. The correlation line was Rate= 0.0005×[*Coprinus cinereus* peroxidase]–0.0003 ($r^2$=0.985).

Upon the addition of 25–90 nM *Coprinus cinereus* peroxidase and 5.3 mM hydrogen peroxide, reduced Vat Orange 7 was reoxidized by the appearance of orange color and the increase of $A_{540}$. The time profile measured at $A_{540}$ was of hyperbolic type as shown in FIG. 5 where the initial reoxidation rate was proportional to the initial concentration of *Coprinus cinereus* peroxidase. The spectrum of the re-oxidized Vat Orange 7 was similar to the spectrum of Vat Orange 7, except that the absorbance at 540 nm for the re-oxidized Vat Orange 7 was only about 80% of that for Vat Orange 7. Reduced Vat Orange 7 could be re-oxidized by hydrogen peroxide, but the presence of *Coprinus cinereus* peroxidase accelerated the reaction. With 94 nM *Coprinus cinereus* peroxidase (10 POXU per ml), the initial reoxidation rate of 0.01% reduced Vat Orange 7 by 5.3 mM hydrogen peroxide was enhanced 10-fold. The presence of PPT further facilitated the reaction. The addition of 0.6 mM PPT led to a 4-fold increase on the initial rate for the reoxidation of 0.01% reduced Vat Orange 7 by 5.3 mM hydrogen peroxide and 24 nM *Coprinus cinereus* peroxidase (2.5 POXU per ml).

*Myceliophthora thermophila* laccase (2.4 $\mu$M, 7.2 LACU per ml) in the presence of ABTS (13 $\mu$M) also re-oxidized reduced Vat Orange 7. However, the *Coprinus cinereus* peroxidase with hydrogen peroxide system was more efficient as an oxidation catalyst than the *Myceliophthora thermophila* laccase/$O_2$/ABTS system. The initial reoxidation rate with 2.4 $\mu$M *Myceliophthora thermophila* laccase and 13 $\mu$M ABTS (and 0.28 mM dissolved $O_2$) was slightly lower than that with 94 nM *Coprinus cinereus* peroxidase and 5.3 mM hydrogen peroxide.

Example 3

Indigo Reduction and Eeoxidation

Swatches (1×1 cm) of indigo dyed desized denim cloth (Swift Textiles, France SA, Paris, France) were immersed in 1.3 ml of 0.1 M NaOH pH 12 containing 0.1 M $Na_2S_2O_4$. After 10 minutes of vortexing, the blue denim cloth turned yellow in color, indicating the reduction of indigo into leuco indigo. The denim cloth swatches with leuco indigo was quickly transferred into capped 1.7-ml centrifuge tubes containing 1.3 ml of either (a) water; (b) 0.1 mM Tris pH 7.8; (c) 0.1 $\mu$M *Myceliophthora thermophila* laccase in 0.1 mM Tris pH 7.8 (0.3 LACU per ml); (d) 0.1 $\mu$M *Myceliophthora thermophila* laccase and 0.1 mM MS in 0.1 mM Tris pH 7.8; or (e) 0.1 mM MS in 0.1 mM Tris, pH 7.8. The tubes were vortexed for 38 minutes. After a 5 second exposure to air, the tubes were vortexed for another 10 minutes.

The leuco-indigo swatches immersed in 0.1 $\mu$M *Myceliophthora thermophila* laccase and 0.1 mM MS in 0.1 mM Tris pH 7.8 turned from yellow to blue, showing the reoxidation of leuco-indigo into indigo. There was no color change in the same time frame when either *Myceliophthora thermophila* laccase or MS was absent.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims. In the case of conflict, the present disclosure including definitions will control.

Various references are cited herein, the disclosures of which are incorporated by reference in their entireties.

What is claimed is:

1. A method for dyeing a material, comprising:

(a) treating the material with a dyeing system which comprises one or more reduced vat dyes or one or more reduced sulfur dyes; and (b) oxidizing the one or more reduced vat dyes or one or more reduced sulfur dyes adsorbed onto the treated material with an oxidation system comprising (i) an oxygen source and one or more enzymes exhibiting oxidase activity, selected from the group consisting of bilirubin oxidase, catechol oxidase, laccase, o-aminophenol oxidase, polyphenol oxidase, ascorbate oxidase, and ceruloplasmin, or (ii) a hydrogen peroxide source and one or more enzymes exhibiting peroxidase activity, is a peroxide or a haloperoxidase, to convert the one or more reduced dyes to their original oxidized insoluble colored forms; wherein the material is a fabric, yarn, fiber, garment or film made of cotton, diacetate, flax, fur, hide, linen, lyocel, polyacrylic, polyamide, polyester, ramie, rayon, triacetate, viscose or.

2. The method of claim 1, wherein said polyamide is leather, silk or wool.

3. The method of claim 1, wherein the one or more reduced vat dyes are selected from the group consisting of an anthraquinone carbazole, anthraquinone oxazole, benzanthrone acridone, dibenzanthrone, flavanthrone, indigo, imidazole, indanthrone, isodibenzanthrone, perylene tetracarboxylic diimide, pyranthrone, triazinylaminoanthraquinone, and violanthrone dye, which are optionally substituted with one or more mono-, di- or polycyclic aromatic or polycyclic heteroaromatic compounds.

4. The method of claim 3, wherein the anthraquinone carbazole, anthraquinone oxazole, benzanthrone acridone, dibenzanthrone, flavanthrone, indigo, imidazole, indanthrone, isodibenzanthrone, perylene tetracarboxylic diimide, pyranthrone, triazinylaminoanthraquinone, or violanthrone dye and the one or more optional mono-, di- or polycyclic aromatic or polycyclic heteroaromatic compound substituents thereof are optionally substituted with one or more functional groups or substituents, wherein each functional group or substituent is selected from the group consisting of halogen; sulfo; sulfonato; sulfamino; sulfanyl; thiol, amino; amido; nitro; azo; imino; carboxy; cyano; formyl; hydroxy; halocarbonyl; carbamoyl; carbamidoyl; phosphonato; phosphonyl; $C_{1-18}$-alkyl; $C_{1-18}$-alkenyl; $C_{1-18}$-alkynyl; $C_{1-18}$-alkoxy; $C_{1-18}$-oxycarbonyl; $C_{1-18}$-oxoalkyl; $C_{1-18}$-alkyl sulfanyl; $C_{1-18}$-alkyl sulfonyl; $C_{1-18}$-alkyl imino or amino which is substituted with one, two or three $C_{1-18}$-alkyl groups.

5. The method of claim 1, wherein the one or more reduced sulfur dyes is selected from the group consisting of a benzothiazole, phenylthiazone, phenazone, and phenoxane dye, which are optionally substituted with one or more mono-, di- or polycyclic aromatic or polycyclic heteroaromatic compounds.

6. The method of claim 5, wherein the benzothiazole, phenylthiazone, phenazone, or phenoxane dye and the one or more optional mono-, di- or polycyclic aromatic or polycyclic heteroaromatic compound substituents thereof are optionally substituted with one or more functional groups or substituents, wherein each functional group or substituent is selected from the group consisting of halogen; sulfo; sulfonato; sulfamino; sulfanyl; thiol, amino; amido; nitro; azo; imino; carboxy; cyano; formyl; hydroxy; halocarbonyl; carbamoyl; carbamidoyl; phosphonato; phosphonyl; $C_{1-18}$-alkyl; $C_{1-18}$-alkenyl; $C_{1-18}$-alkynyl; $C_{1-18}$-alkoxy; $C_{1-18}$-oxycarbonyl; $C_{1-18}$-oxoalkyl; $C_{1-18}$-alkyl sulfanyl; $C_{1-18}$-alkyl sulfonyl; $C_{1-18}$-alkyl imino or amino which is substituted with one, two or three $C_{1-18}$-alkyl groups.

7. The method of any of claim 1, wherein the oxidation system comprises one or more enzymes exhibiting oxidase activity on the one or more reduced vat dyes and/or one or more reduced sulfur dyes and an oxygen source.

8. The method of any of claim 1, wherein the oxidation system comprises one or more enzymes exhibiting peroxidase activity on the one or more reduced vat dyes or one or more reduced sulfur dyes, and a hydrogen peroxide source.

9. The method of claim 8, wherein the hydrogen peroxide source is hydrogen peroxide, perborate, or percarbonate.

10. The method of any of claim 1, wherein the dyed material is treated with the oxidation system at a temperature in the range of about 5° C. to about 120° C.

11. The method of any of claim 1, wherein the dyed material is treated with the oxidation system at a pH in the range of about 2.5 to about 12.

12. The method of any of claim 1, wherein the dyed material is treated with the oxidation system for a time in the range of about 0.1 minute to about 60 minutes.

13. The method of any of claim 1, wherein the oxidation system further comprises a chemical mediator which enhances the activity of the one or more enzymes.

14. The method of claim 13, wherein the chemical mediator is a phenolic compound.

15. The method of claim 14, wherein the chemical mediator is methyl syringate.

16. The method of claim 13, wherein the chemical mediator is selected from the group consisting of an N-hydroxy compound, N-oxime compound, N-oxide compound, phenoxazine compound, and phenathiazine compound.

17. The method of any of claim 1, wherein the dyeing system comprises one or more reduced vat dyes and one or more reduced sulfur dyes.

18. The method of any of claim 1, wherein the oxidation system comprises (i) an oxygen source and one or more enzymes exhibiting oxidase activity and (ii) a hydrogen peroxide source and one or more enzymes exhibiting peroxidase activity.

* * * * *

UNITED STATES PATENT AND TRADEMARK OFFICE

CERTIFICATE OF CORRECTION

PATENT NO. : 5,948,122
DATED : September 7, 1999
INVENTOR(S) : Xu et al.

It is certified that error appears in the above-identified patent and that said Letters Patent is hereby corrected as shown below:

Col. 17, line 27: delete "viscose or." and insert --or viscose.--
Col. 17, line 36: delete "carboxylic diimide, pyranthone" and insert -- carboxylic diimide, pyranthone--

Signed and Sealed this

Fourth Day of July, 2000

*Attest:*

*Attesting Officer*

Q. TODD DICKINSON

*Director of Patents and Trademarks*